US011871836B2

(12) United States Patent
Kayyal et al.

(10) Patent No.: US 11,871,836 B2
(45) Date of Patent: Jan. 16, 2024

(54) PORTABLE HAMMOCK FRAME AND BED

(71) Applicants: Amjad Kayyal, Montreal (CA); Sasha Boucicaut, Montreal (CA)

(72) Inventors: Amjad Kayyal, Montreal (CA); Sasha Boucicaut, Montreal (CA)

(73) Assignee: Amjad Kayyal

( * ) Notice: Subject to any disclaimer, the term of this patent is extended or adjusted under 35 U.S.C. 154(b) by 133 days.

(21) Appl. No.: 17/650,681

(22) Filed: Feb. 11, 2022

(65) Prior Publication Data

US 2022/0248833 A1 Aug. 11, 2022

Related U.S. Application Data

(60) Provisional application No. 63/148,248, filed on Feb. 11, 2021.

(51) Int. Cl.
*A45F 3/24* (2006.01)

(52) U.S. Cl.
CPC ..... *A45F 3/24* (2013.01)

(58) Field of Classification Search
CPC ..... A45F 3/22; A45F 3/24; A45F 3/26; A45F 4/08
See application file for complete search history.

(56) References Cited

U.S. PATENT DOCUMENTS 902,087 A * 10/1908 King ..... A45F 3/24 135/96
4,862,906 A * 9/1989 Jordon ..... A45F 3/22 5/120
5,588,702 A * 12/1996 Litwin ..... A47C 3/0255 297/277
5,636,392 A * 6/1997 Choi ..... A45F 3/24 5/127
5,983,422 A * 11/1999 Bayless ..... A45F 3/24 5/120
6,467,109 B1 * 10/2002 Wu ..... A45F 3/24 5/120
6,711,764 B1 * 3/2004 Mauze, Jr. ..... A45F 3/24 5/120
6,931,679 B1 * 8/2005 Tseng ..... A61K 31/513 5/127
6,973,687 B1 * 12/2005 Tseng ..... A45F 3/24 5/127
2004/0172752 A1 * 9/2004 Vo ..... A45F 3/24 5/127
2005/0060802 A1 * 3/2005 Zhong ..... A45F 3/24 5/120
2005/0262631 A1 * 12/2005 Clark ..... A45F 3/24 5/127

(Continued)

*Primary Examiner* — Justin C Mikowski
*Assistant Examiner* — George Sun

(57) ABSTRACT

In a preferred embodiment, a hammock suspension structure is provided. The frame is light and foldable, and portable. This allows it to be taken to many different environments and provides a self-sufficient structure to enjoy a hammock once unfolded into its final shape from its folded, portable configuration. Furthermore, its unique design makes it particularly light and capable of supporting a high load (e.g., up to 250 kg), therefore allowing more than one person to utilize it at the same time. The hammock bed convertible allows a more defined transformation from bed to sofa configuration, and vice versa.

14 Claims, 23 Drawing Sheets

(56) References Cited

U.S. PATENT DOCUMENTS

| | | | | |
|---|---|---|---|---|
| 2007/0017026 | A1* | 1/2007 | Lam | A45F 3/24 5/127 |
| 2007/0051858 | A1* | 3/2007 | Bailey | A45F 3/26 248/127 |
| 2010/0024124 | A1* | 2/2010 | Reeb | A45F 3/24 5/129 |
| 2014/0259395 | A1* | 9/2014 | Yang | A45F 3/24 5/129 |
| 2019/0082816 | A1* | 3/2019 | Nguyen | A47C 17/84 |
| 2020/0260845 | A1* | 8/2020 | Bingener | A45F 3/24 |

* cited by examiner

HSS Unfolded Side View (wide)

HSS Unfolded Side View (narrow)

HSS Unfolded Top View

HSS Side View (Semi-Folded)

HSS Top View (Semi-Folded)

HSS Fully Folded View 1

HSS Fully Folded View 2

HSS Fully Folded View 3

HSS Folded Top View

A) Fully Unfolded HSS with Bed Config HBC

B) Fully Unfolded HSS with Sofa Config HBC

Fully Unfolded HSS with Cocoon Hammock
(L-Bars Removed)

Semi-folded HSS with Chair Hammock
(3rd party hammock, or HBC shortened through unshown mechanism)

PORTABLE HAMMOCK FRAME AND BED

CROSS REFERENCE TO RELATED APPLICATIONS

The application claims priority to and the benefit of U.S. Provisional Patent Application Ser. No. 63/148,248, entitled "PORTABLE HAMMOCK FRAME AND BED", filed on Feb. 11, 2021, the disclosure of which is incorporated herein by reference in its entirety.

BACKGROUND

The embodiments described herein relate to a portable hammock frame and hammock bed capable of transforming into a sofa.

Hammock beds have existed for a long time but require two existing pillars or poles (such as trees or posts) to be tied to, to set up the hammock bed. In order to circumvent the lack of availability of the pillars, frames simulating these pillars have also been created.

Existing frame designs are typically not portable and must practically be restricted to certain locations. It has been a challenge to take a hammock bed with you to locations where pillars do not exist. Furthermore, transporting hammock frames can be cumbersome. As an example, a portable hammock bed would be desirable to use at a beach or park where it can be packed up for portable transportation, easily deployed during use, and easily repackaged for transportation back home.

It is desirable to have a portable hammock bed design for easy transportation.

SUMMARY

In a preferred embodiment, a hammock frame bed is provided. The frame is light and foldable, and portable. This allows it to be taken to many different environments and provides a self-sufficient structure to enjoy a hammock once unfolded into its final shape from its folded, portable configuration. Furthermore, its unique design makes it particularly light and capable of supporting a high load (e.g., up to 250 kg), therefore allowing more than one person to utilize it at the same time.

On average, the typical hammock bed provides very little flexibility in terms of configuration. An ideal bed would be one that can also be configured into a couch, which allows users not only to lie in a bed configuration, but also sit in a comfortable sofa configuration, where the sagging is now minimized, and they have a more natural sofa position.

DETAILED DESCRIPTION

In a preferred embodiment, a hammock suspension structure (HSS) with a hammock bed convertible (HBC) is disclosed. According to the preferred embodiment, the hammock suspension structure (HSS) consists of a light, foldable and portable frame. This allows it to be taken to many different environments and provides a self-sufficient structure to enjoy a hammock once unfolded into its final shape from its folded, portable configuration. Furthermore, its unique design makes it particularly light and capable of supporting a high load (e.g., up to 250 kg), therefore allowing more than one person to utilize it at the same time. The Hammock Bed Convertible (HBC) further increases the utility of hammock structure by providing a multitude of configurations that can be taken to multiple environments and accommodate multiple people.

Figure 1A:
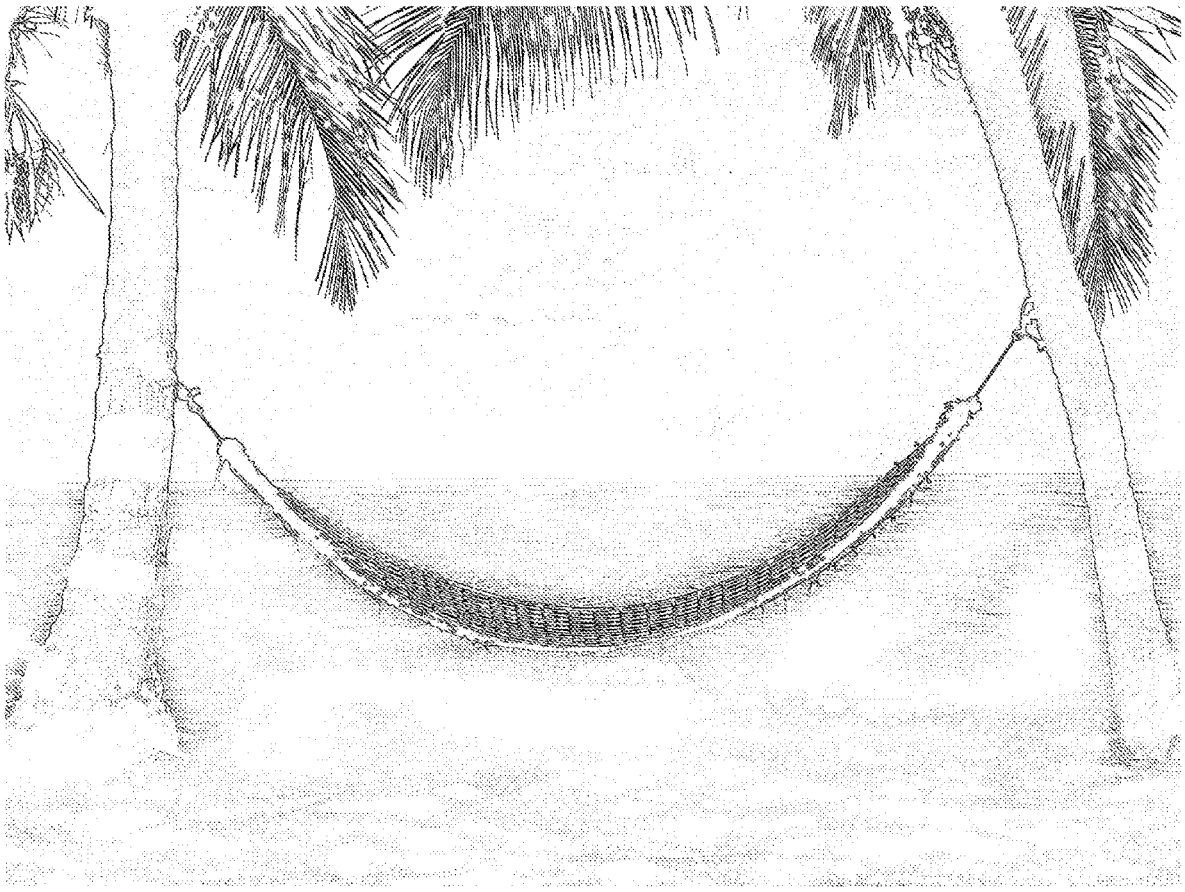
FIG. 1A is a diagram illustrating a typical hammock and one which requires pre-existing pillars to accommodate them.

FIG. 1A is an illustration showing an exemplary hammock bed design. According to FIG. 1A, there exists two solid structures of one type or another that the hammock can be attached to. A hammock is connected to both ends.

Figure 1B:
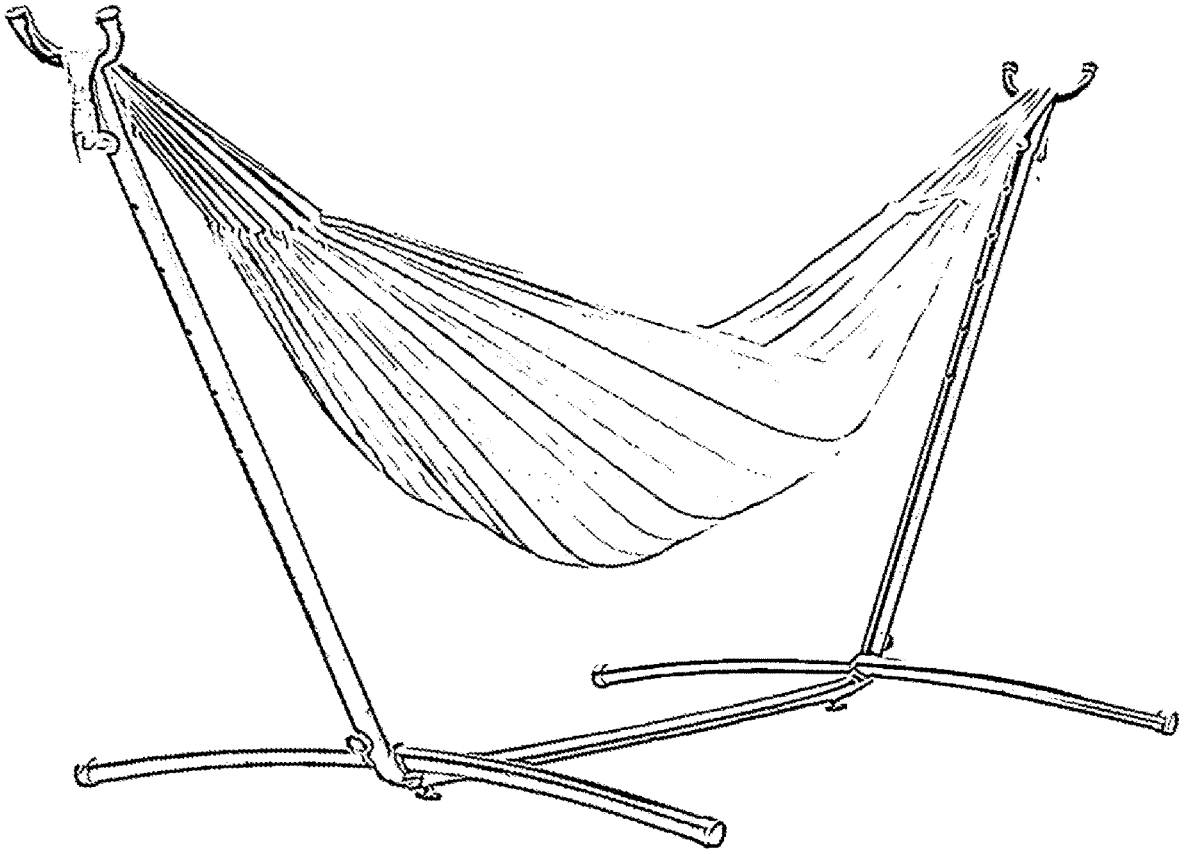
FIG. 1B is a diagram illustrating a further embodiment of a typical hammock frame design with simulated pillars in a rigid frame, but one which is not very portable.

FIG. 1B is an illustration showing a typical hammock bed design. According to FIG. 1B, there exist two hammock poles or suspension bars and a plurality of middle bars. The middle bars are placed parallel to the floor (e.g., a flat surface) and joined by connectors. The end folding middle bars are connected to the hammock poles (suspension bars) and are connected at an obtuse angle (greater than 90 degrees). A hammock bed is connected to both ends of the hammock poles and can swing side to side in that suspension. The hammock can be made of cotton, bamboo, polyester, wool, and other suitable fabric material.

Figure 1C:
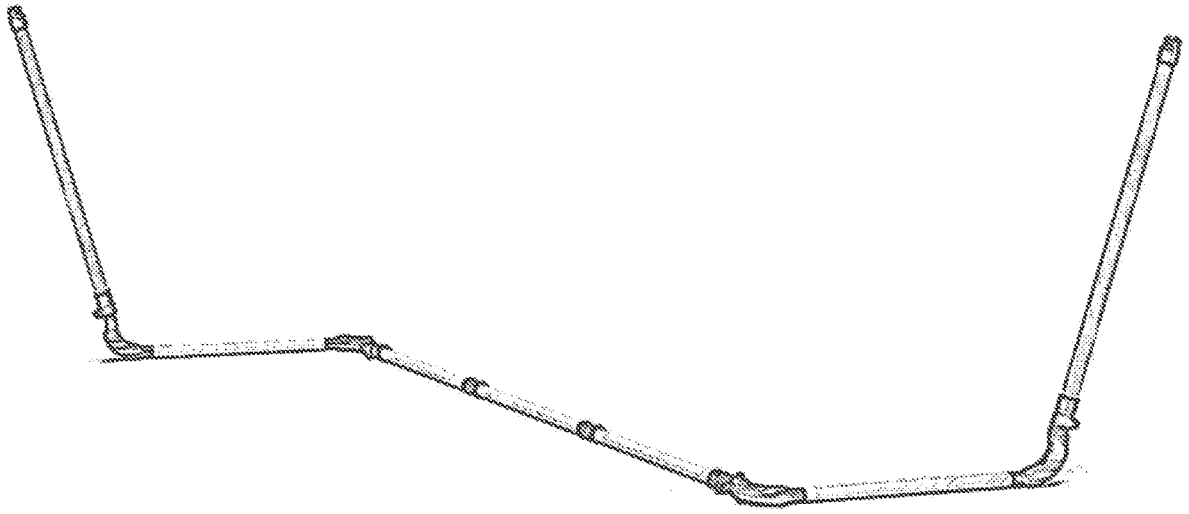
FIG. 1C is a render illustrating the design of the first component of a Hammock Suspension Structure (HSS).

FIG. 1C is a render illustrating the design of the first component of a Hammock Suspension Structure (HSS). FIG. 1C illustrates the frame for the HSS design. Dimensions of an exemplary HSS can vary greatly. In this preferred embodiment, they stretch approximately 300 cm (length, from the top of one vertical pole to another)×approximately 180 cm (width)×approximately 100 cm (height) and can support up to a weight of around 250 kg (550 lbs.) according to materials used in construction. Again, various materials and dimensions are possible within the confines of the design.

Figure 2:
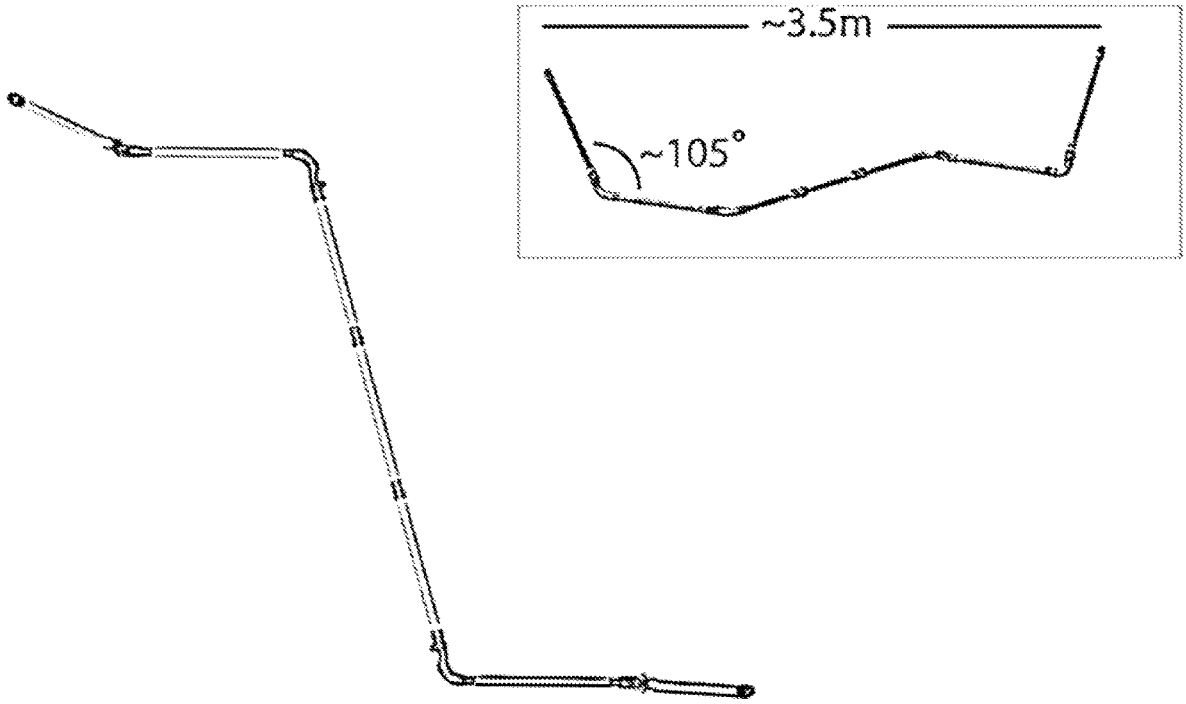
FIG. 2 is a render illustrating a frame of the HSS (top view and covering most basic attributes).

FIG. 2 is a render illustrating the top view of the frame of an HSS design. In a preferred embodiment, the suspension bars (poles) are angled at approximately 105 degrees away from the middle bar at a height of about 100 cm, and a total suspension distance of about 300 cm. In a preferred embodiment, there are 5 folding horizontal bars, and 2 folding vertical bars. However, other embodiments may have more or fewer folding bars with a characteristic creation of a "Z" design.

Figure 3A:
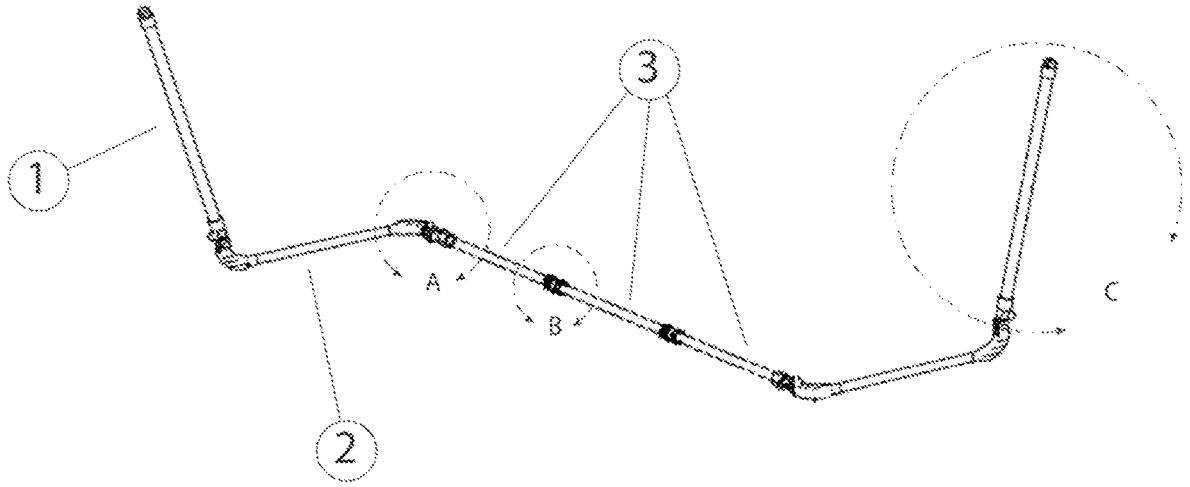
FIG. 3A is a line diagram illustrating a snapshot of the frame of the HSS, with its most salient sections, to be elaborated further below.

FIG. 3A is a line diagram illustrating the frame of the HSS with multiple segments. According to FIG. 3A, there are 3 main areas of complexity, which are further shown in Detail in FIG. 3B, FIG. 3C, FIG. 3D, FIG. 3E, FIG. 3F, FIG. 3G, and FIG. 3H respectively.

FIG. 3A further illustrates long rods 1 and 2 and short rods 3 are made of bamboo, preferably Moso cane, but other materials such as plastic, aluminum, steel, and carbon fiber will be considered. Long rods 1 are connected to long rods 2 by means of angled hinge A at each end. Angled hinge A is preferably made of carbon fiber, though other materials may be considered. Long rods 2 are connected to short rods 3 by means of another angled hinge A at each end. Short rods 3 are connected to each other by means of two straight hinges B. Long rods 1 contain a cable mechanism C. The following figures explore areas A, B, and C in detail.

Figure 3B:
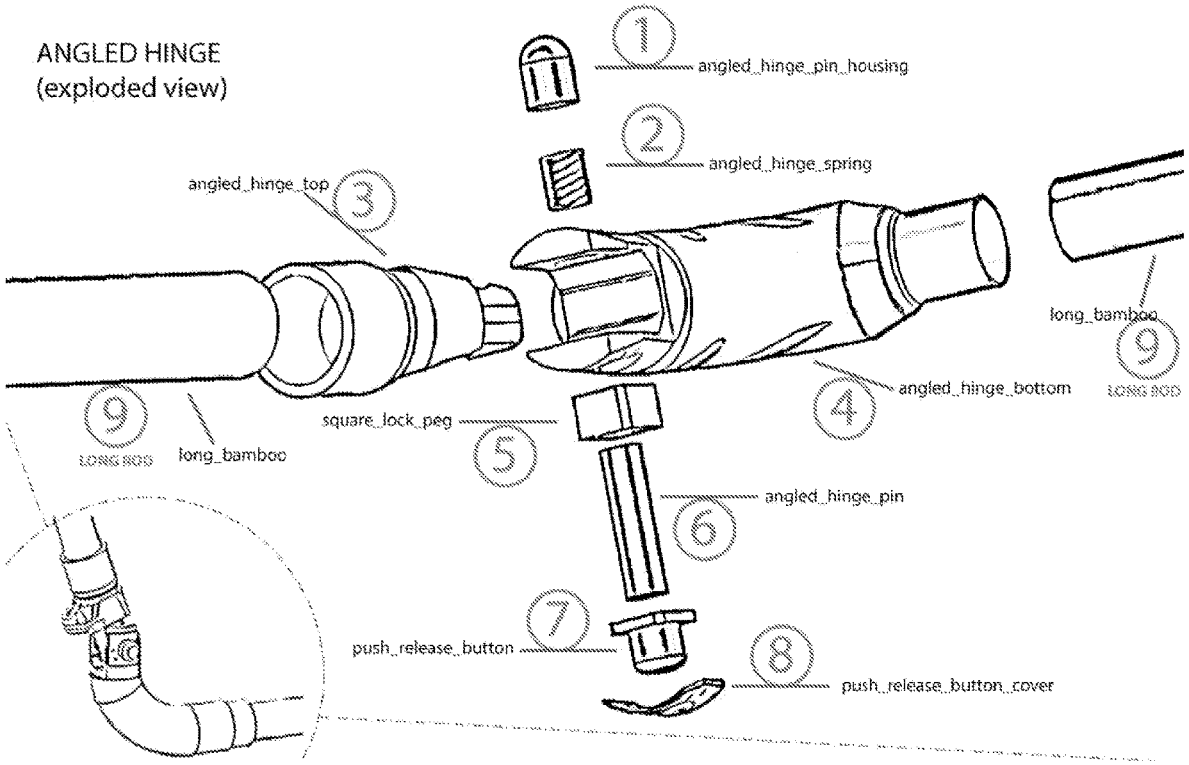
FIG. 3B is a render (with exploded view) illustrating Detail A of the HSS as seen in FIG. 3A.

FIG. 3B is a render illustrating Detail A of the HSS as seen in FIG. 3A. According to FIG. 3B, Detail A, consists of an angled hinge, itself composed of angled_hinge_top 3 and angled_hinge_bottom 4. When the user unfolds the rods 9, hinges 3 and 4 pivot around the angled_hinge_pin 6. At that point the angled_hinge_spring 2, housed in the angled_hinge_housing 1, pushes the square_lock_peg 5 into the square hole on the side of hinge 4, locking it into place, and preventing the hinge from folding back down. When the user wishes to fold everything back, they push the push_release_button 7 (kept in place by the push_release_button_cover 8) inwards, thereby pushing peg 5 back inside, away from the square hole, and allowing the hinge to fold back in, along with the rods connected to it. In this embodiment, all the above-mentioned parts are made of carbon fiber, except for the pin 6 and the spring 2, which would be made of stainless steel, titanium, or aluminum. In other embodiments, carbon fiber can be replaced (for some or all parts) with any other suitable material, such as hard plastic, titanium, or any material with right properties.

Figure 3C:
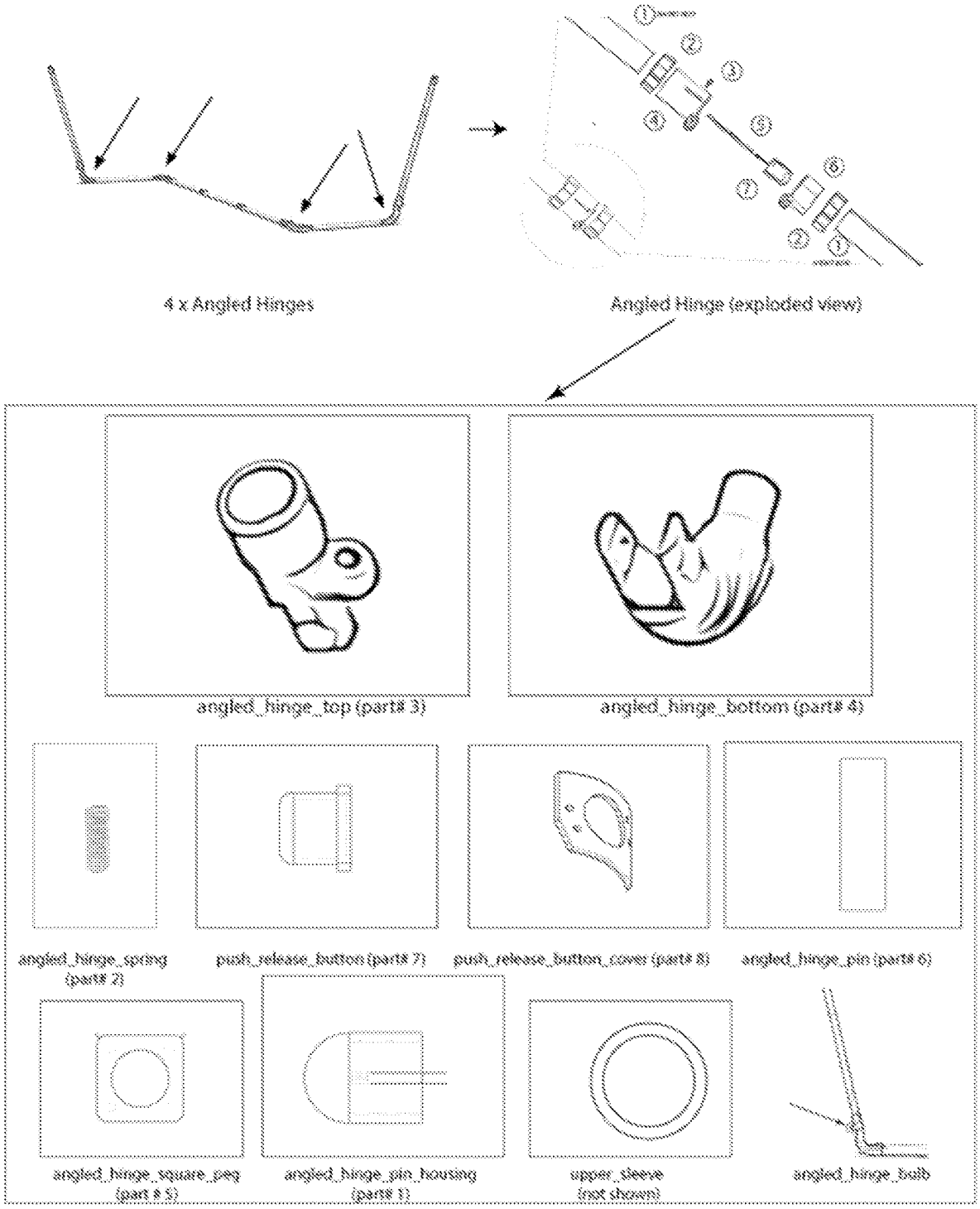
FIG. 3C is a set of illustrations further elaborating the constituent parts of Detail A of the HSS as seen in FIG. 3A.

FIG. 3C is a set of line diagrams further illustrating the constituent parts of Detail A as seen in FIG. 3A.

Figure 3D:
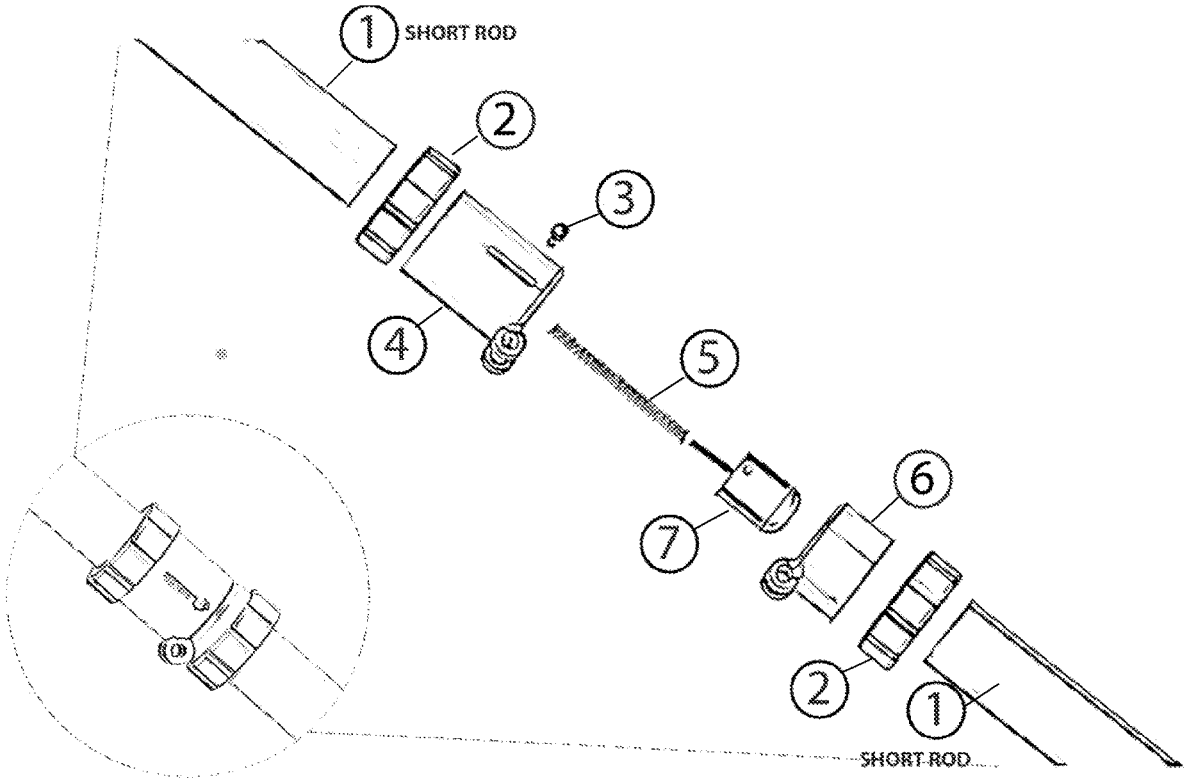
FIG. 3D is a render (with exploded view) illustrating Detail B of the HSS as seen in FIG. 3A.

FIG. 3D is a render illustrating Detail B of the HSS as seen in FIG. 3A. According to FIG. 3D, Detail B consists of straight_hinge_half_large 4 and a straight_hinge_half_small 6, connected to short rods 1. When unfolded, the straight_hinge_spring 5 pushes the straight_hinge_piston 7 into the cavity inside hinge 6, thereby rigidly situating itself between hinges 4 and 6, and locking them in place in the unfolded position. When the user wishes to fold everything back up, they pull back the straight_hinge_screw 3 (which is connected through a groove on hinge 4 to piston 7), pulling piston 7 back into its housing in hinge 4, and allowing hinges 4 and 6 to fold back up. Furthermore, hinges 4 and 6 are connected to short rod 1 with ring connector 2.

In a preferred embodiment, Detail B will be made of carbon fiber (except for screw 3 and spring 5, which will be made of stainless steel), although any suitable material may be considered for any of the above-mentioned parts.

Figure 3E:
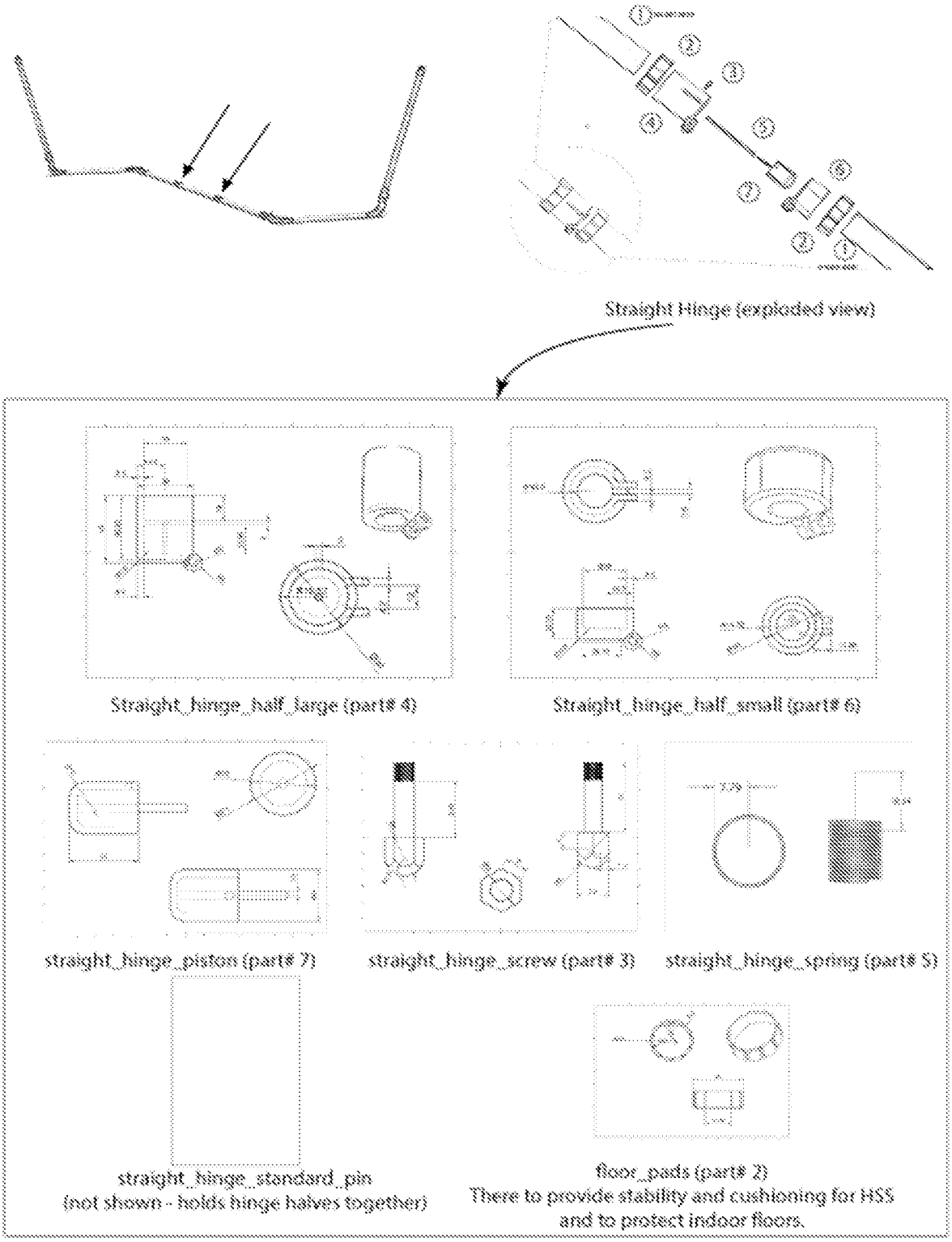
FIG. 3E is a set of illustrations further elaborating the constituent parts of Detail B of the HSS as seen in FIG. 3A.

FIG. 3E is a set of line diagrams further illustrating the constituent parts of Detail B as seen in FIG. 3A.

Figure 3F:
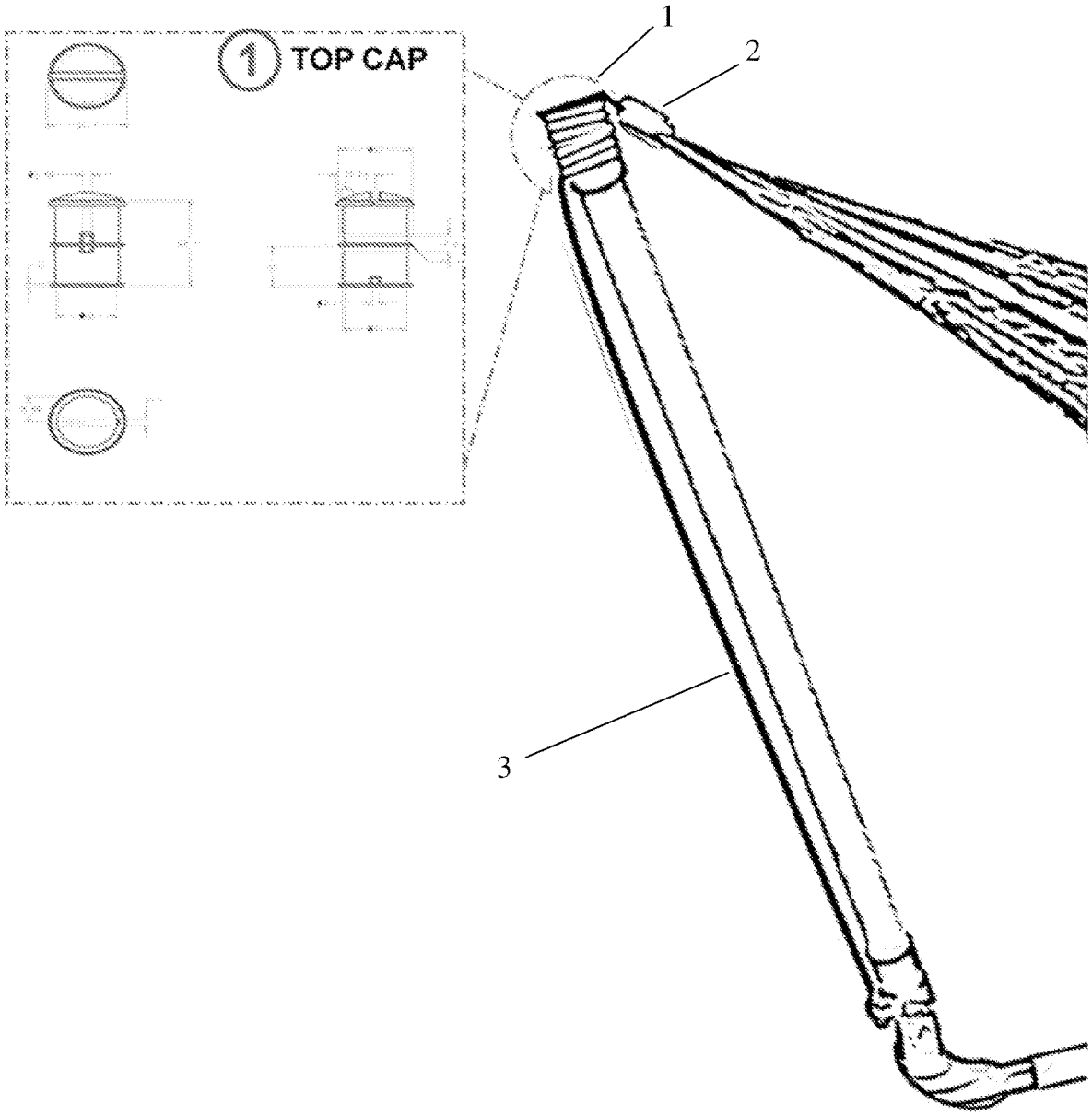
FIG. 3F is a render illustrating Detail C of the HSS as seen in FIG. 3A.

FIG. 3F is a render illustrating Detail C of the HSS as seen in FIG. 3A. The HBC (or any hammock) is suspended on the HSS through a cable system. The cable 3 connects at one end to a standard carabiner 2 and on the other end to the bottom of the vertical angled hinge bulb 4 (which is knotted below it or otherwise restricted). In the middle of all of this, it goes through the cap 1 in such a way (described in following points) to redistribute the forces (gravity pulling down the HBC, and consequently pulling on the long rods) in a manner reorienting said forces to be more parallel to the orientation of the long rods. How this is accomplished is described below. The top cap 1 can be made of carbon fiber or hard plastic. The cable 3 can be made of steel, or high-load natural or synthetic fiber.

Figure 3G:
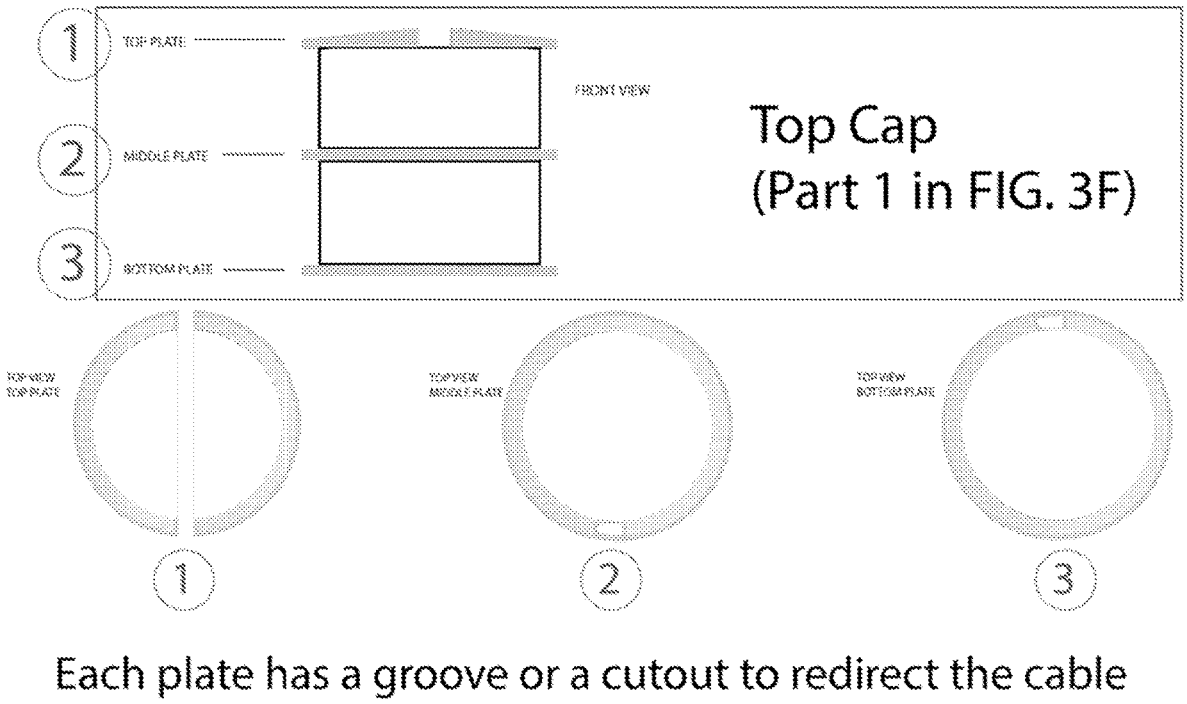
FIG. 3G is a set of illustrations further elaborating the constituent parts of Detail C of the HSS as seen in FIG. 3A.

FIG. 3G is an illustration showcasing the basic design of the top cap, first described in FIG. 3F. The cap is specifically designed to redistribute forces along the vertical axis and in a manner that corresponds to the vertical rod's strongest plane (parallel to it). To achieve this, a groove is created at the cap's top to direct the cable coming from the hammock bed onto a specific path around the cap. In total there are 3 plates that redirect the cable. The top plate 1 directs the cable coming from the hammock bed, the middle plate 2 reverses the cable's orientation and the bottom plate 3 determines where the cable leaves the cap (in the orientation of the long rod, and toward the bottom).

Figure 3H:
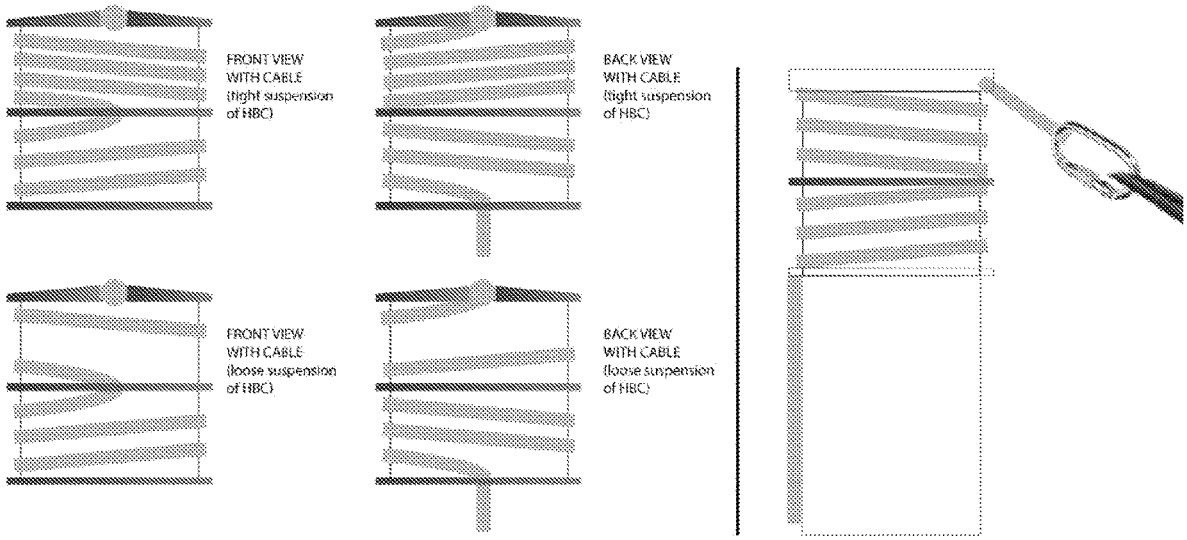
FIG. 3H is a set of illustrations further elaborating the constituent parts of Detail C of the HSS as seen in FIG. 3A.

FIG. 3H showcases the process of wrapping the cable along the cap's circumference in 2 opposing directions which helps redistribute forces more equally. Furthermore, it allows the user to determine how tight (high) or loose (low) the HBC should be suspended between the poles of the HSS, based on their preference. This is done by simply wrapping the cable around the top half of the cap more times (for tight) or fewer times (for loose).

Figure 4:
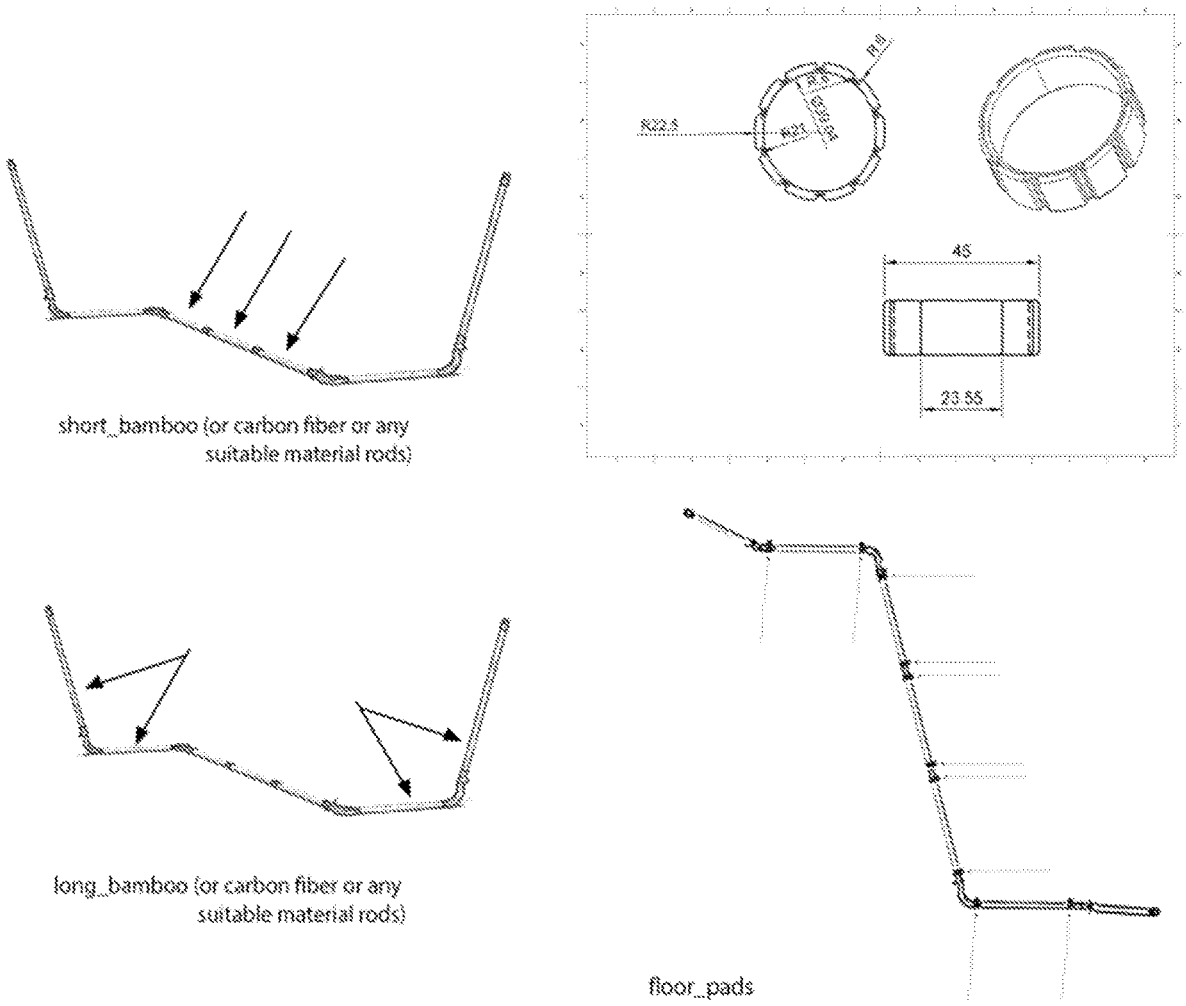
FIG. 4 is a diagram illustrating a main skeleton of the HSS.

FIG. 4 is a set of renders showing the main skeleton of the HSS with its short and long rods. FIG. 4 also shows the floor pads, which are also first illustrated in FIG. 3D. In a preferred embodiment, they are made of silicon, rubber, or other high friction material, and designed to make contact with the floor and to protect the floor and base from damage, while providing stability and cushioning for the HSS.

Figure 5A:
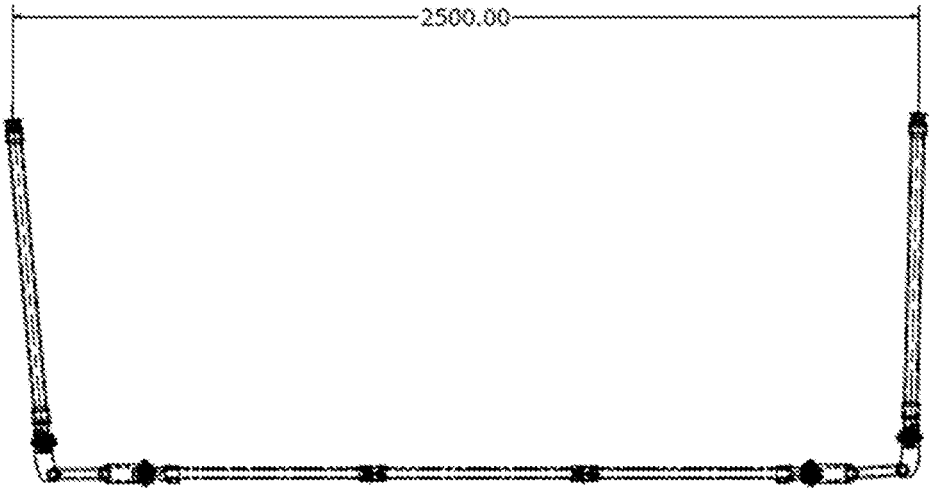
FIG. 5A is a diagram illustrating a front view of the HSS (with dimensions of current embodiment).

FIG. 5A is a diagram illustrating a front view of the dimensions of a hammock frame. According to FIG. 5A, the length of the HSS is 2500 mm (or 2.5 m), without counting the diagonal distance between vertical poles. The long rods have a diameter of 38 mm (0.038 m). The short rods have a diameter of 33 mm (0.033 m). According to FIG. 5A, the material of the middle bars is made of light and flexible material such as bamboo or carbon fiber. The forces on the middle section of the hammock are compressive, such that the middle bars do not bend or flex too much. Furthermore, the middle bars when deployed, may conform to uneven terrains, and would require a certain level of flexibility.

Figure 5B:
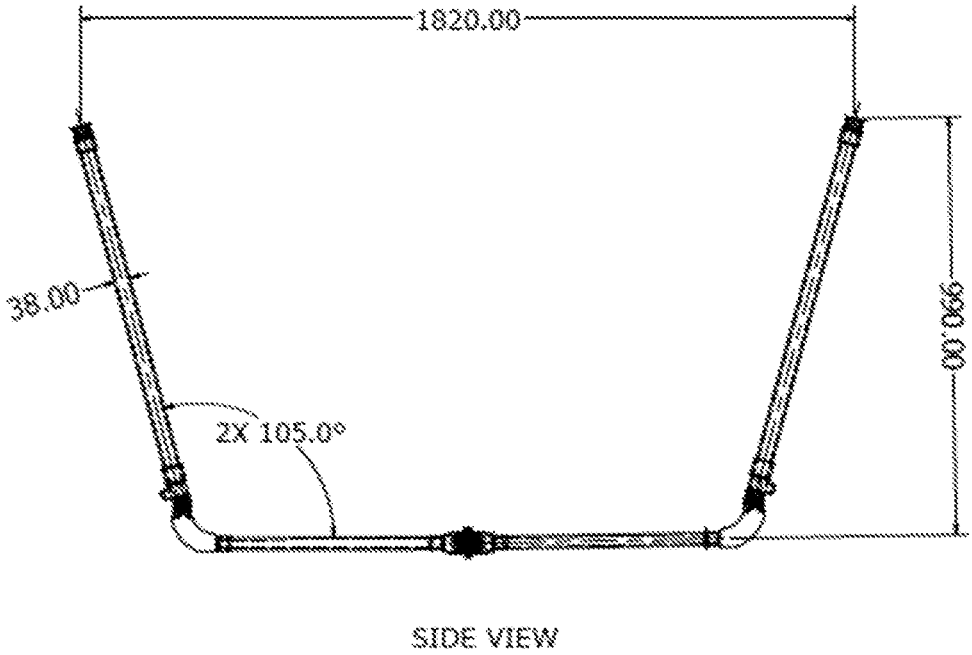
FIG. 5B is a diagram illustrating a side view of the HSS (with dimensions of current embodiment).

FIG. 5B shows that the width of the HSS is 1820 mm (or 1.82 m). The angle at which the vertical rods incline is 105°.

Figure 5C:
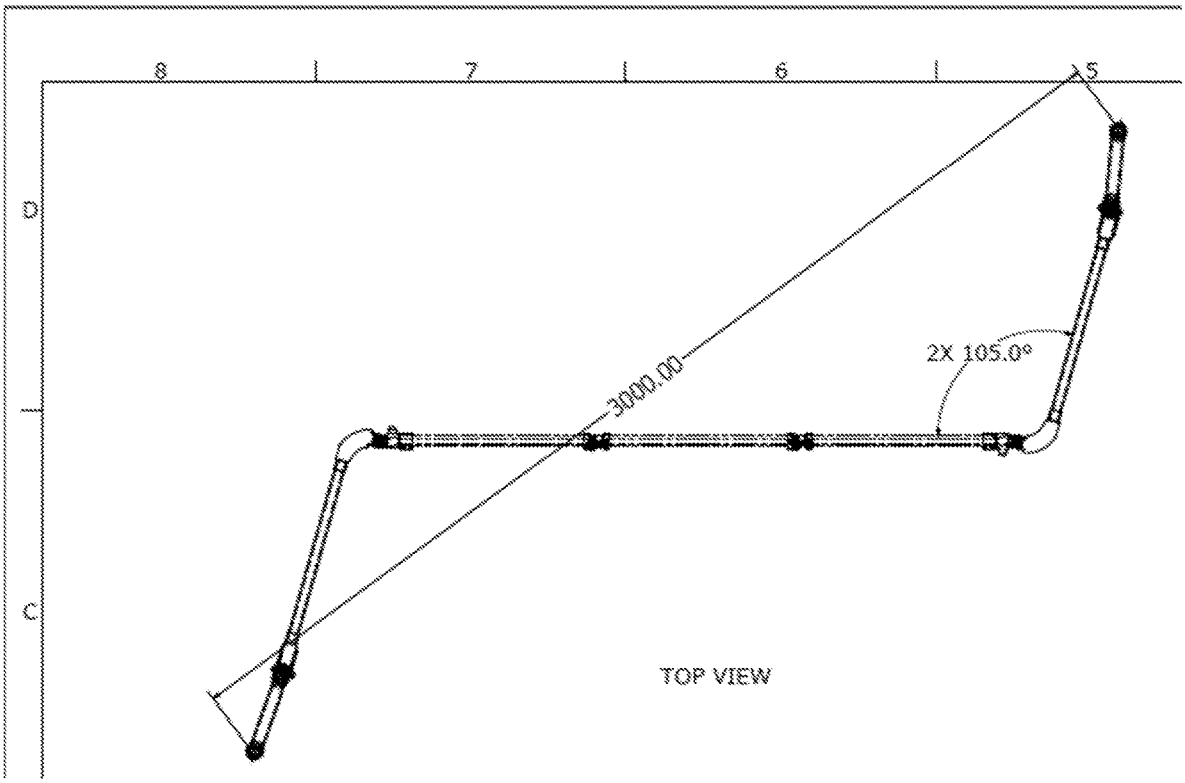
FIG. 5C is a diagram illustrating a top view of the HSS (with dimensions of current embodiment).

FIG. 5C shows the total diagonal suspension distance from the top of one vertical rod to the other at 3000 mm (or 3.00 m). As the same hinge is deployed on the ground as the vertical, the angle is also 105°.

Figure 6A:
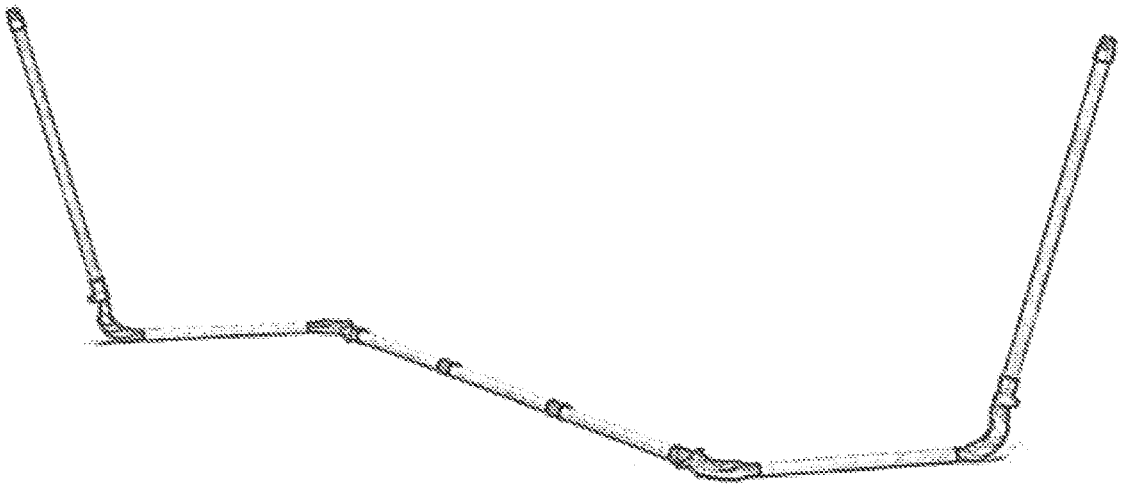
FIG. 6A is a set of renders illustrating various angles of the HSS in the fully unfolded configuration.
Figure 6A:
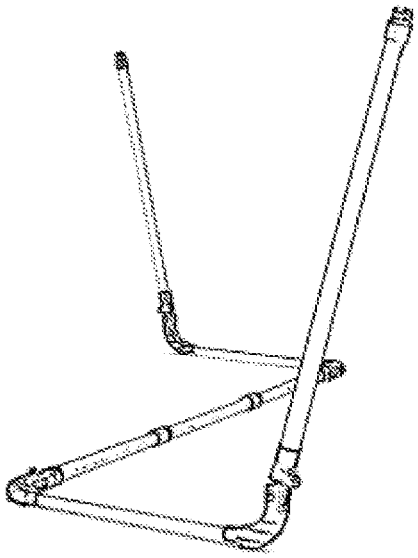
Figure 6A:
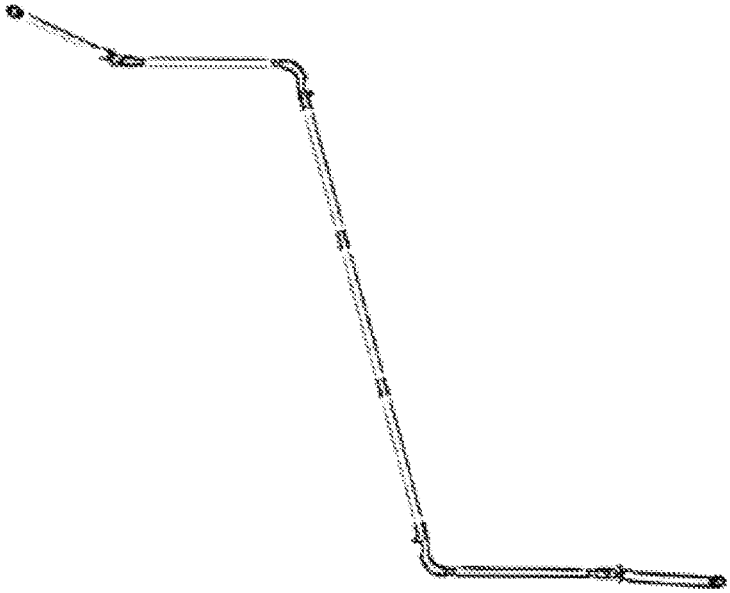

FIG. 6A is a set of renders showing the HSS in the fully unfolded position, from varying angles.

Figure 6B:
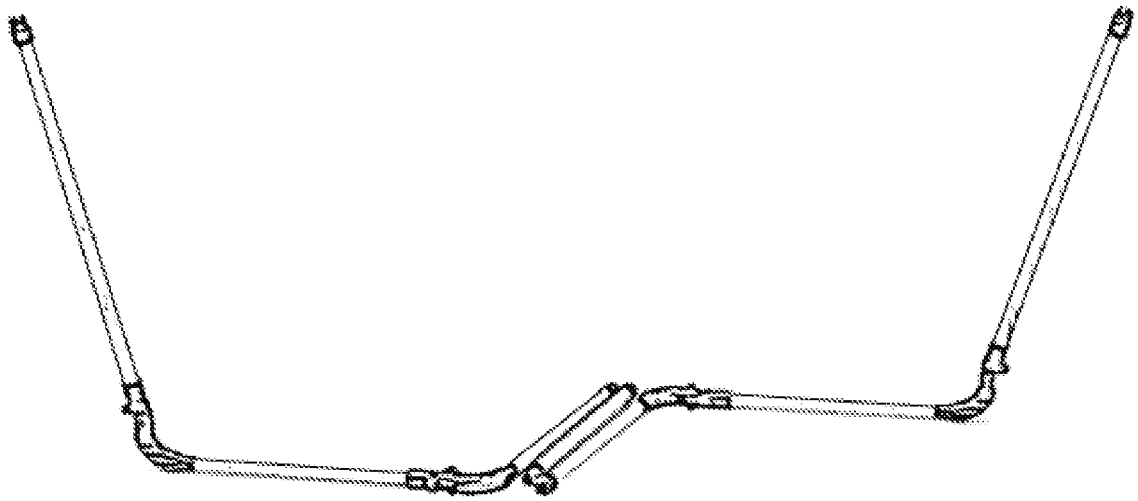
FIG. 6B is a set of renders illustrating various angles of the HSS in the semi-unfolded configuration.
Figure 6B:
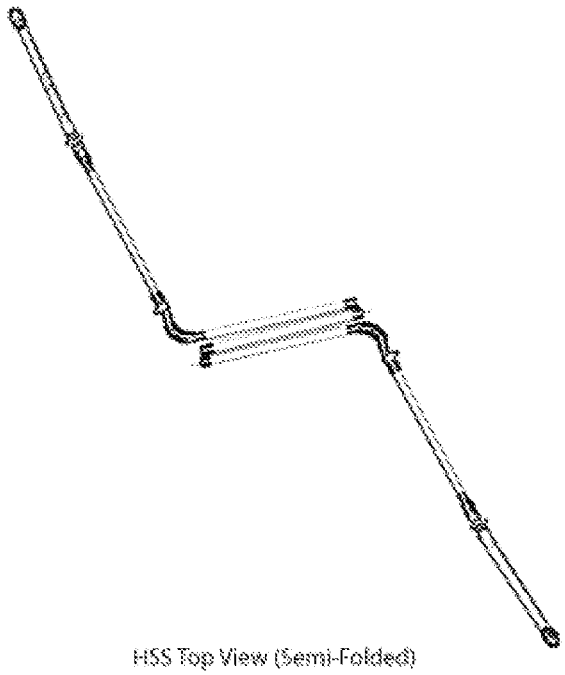

FIG. 6B is a set of renders showing the HSS in the semi-folded position, from varying angles. This position allows it to accommodate a smaller 'chair-type' hammock.

Figure 6C:
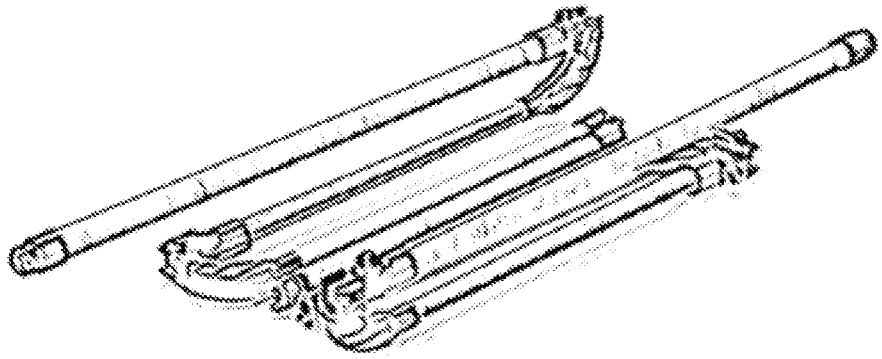
FIG. 6C is a set of renders illustrating various angles of the HSS in the completely folded configuration.
Figure 6C:
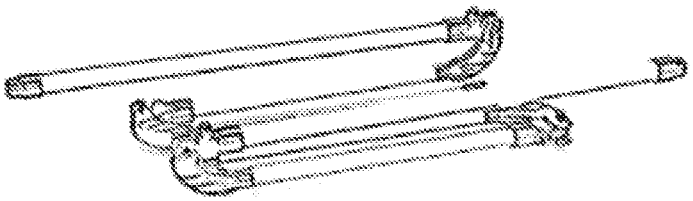
Figure 6C:
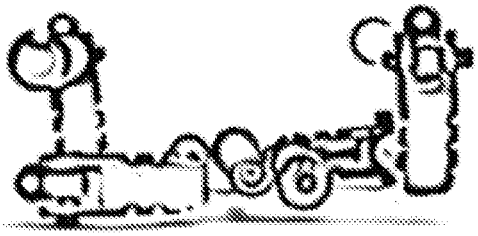
Figure 6C:
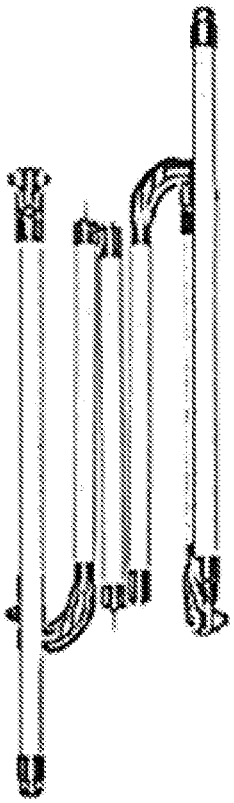

FIG. 6C is a set of renders showing the HSS in the fully folded position, from varying angles. This is the configuration that allows it to be portable and stored more efficiently.

Figure 7A:
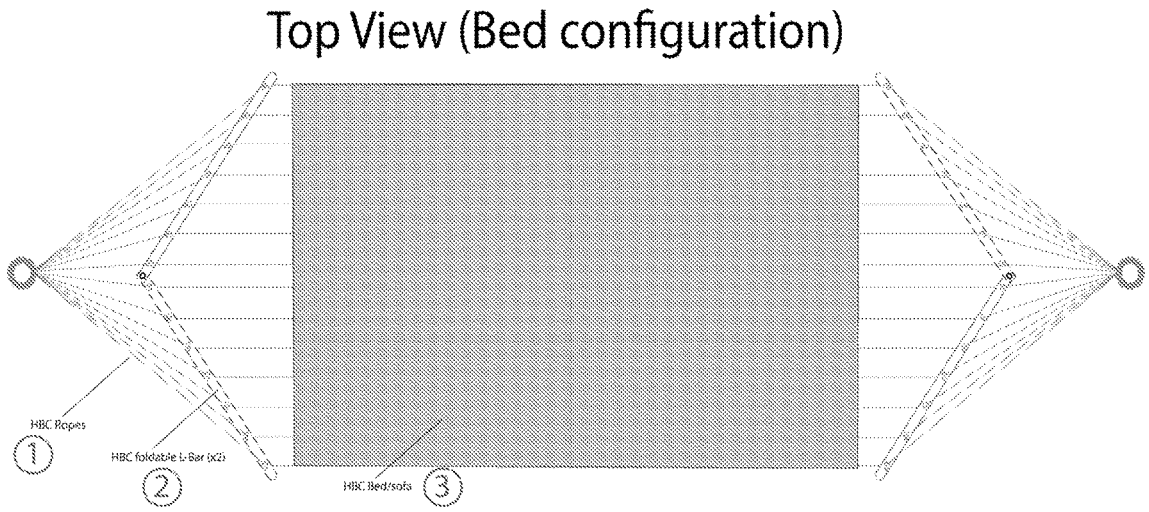
FIG. 7A is an illustration of the top view of the second component of Hammock Bed Convertible (HBC).

FIG. 7A is an illustration of the top view of the second component of Hammock Bed Convertible (HBC). According to FIG. 7A, this is a top view of the HBC unfolded, and therefore in the 'Bed' configuration. The HBC has basic and familiar components in the ropes 1 and the fabric 3, but additionally, it includes two foldable L-Bars 2. These are crucial in transforming the HBC from the 'Bed' configuration to the 'Sofa' configuration. The following points will elaborate on that, as well as the structure of the L-Bars.

Figure 7B:
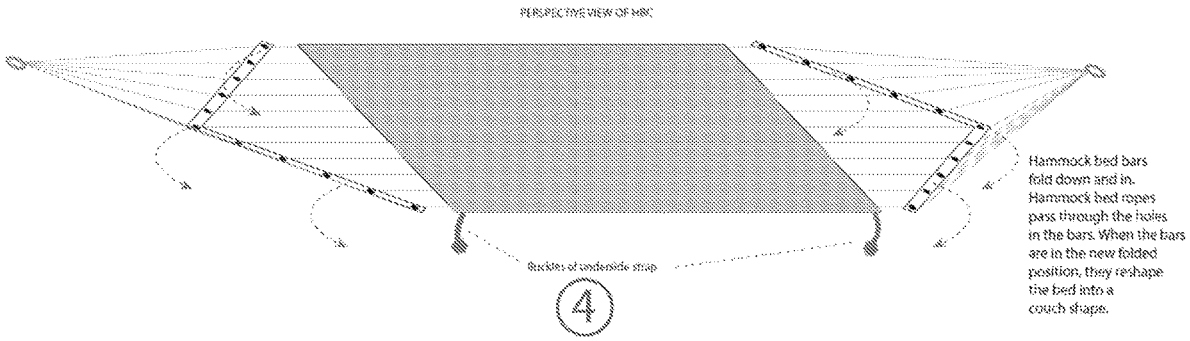
FIG. 7B is an illustration of the HBC of FIG. 7A in perspective view, showing how the stabilizer L-bars can be moved through the ropes to shape the HBC from bed to sofa.

FIG. 7B is an illustration of the same HBC in perspective. It also shows the buckles of the underside rigid fabric straps (showcased in FIG. 7D). FIG. 7B begins to show how the L-bars 2 can fold/slide down through the ropes 1 to change the shape and orientation of the HBC fabric 3. More details are below.

Figure 7C:
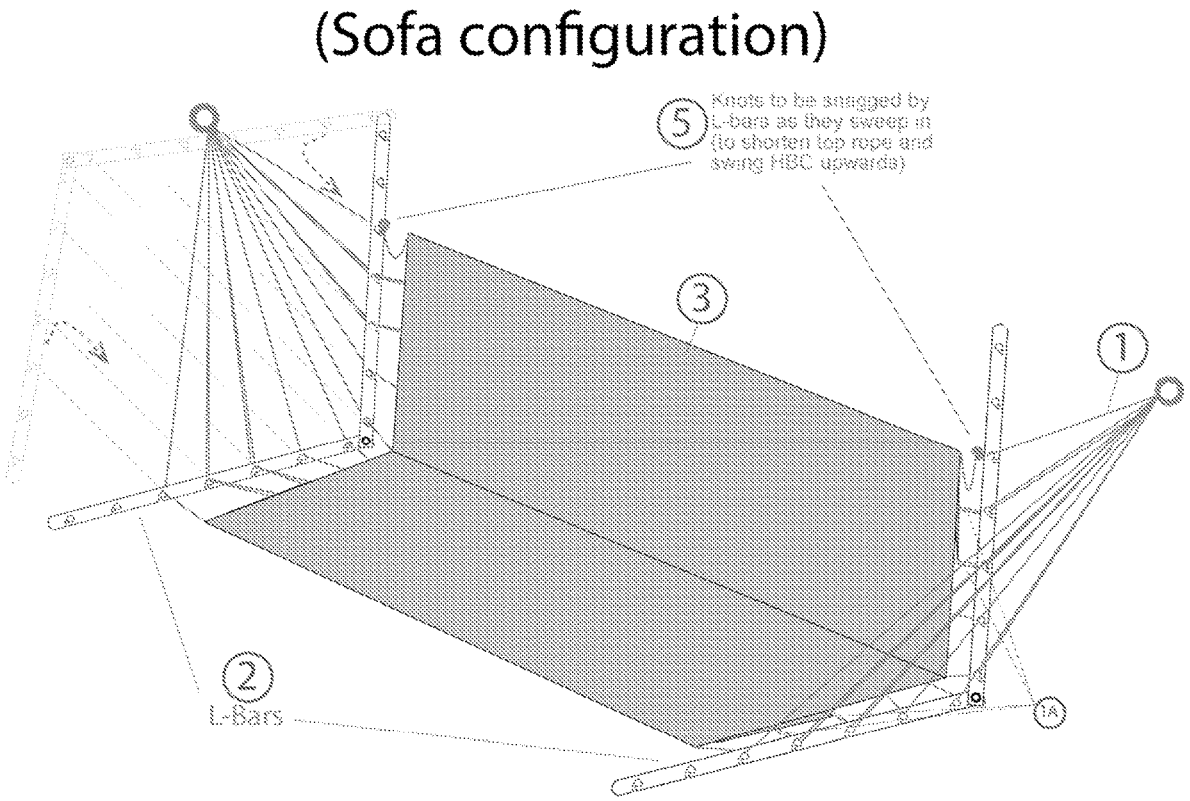
FIG. 7C is an illustration of the HBC with the stabilizer L-bars moved into the sofa position, and subsequently changed from the shape of a bed into a sofa.

FIG. 7C is an illustration of the HBC, having been converted into the sofa position. In this process of conversion, the following steps take place:

a) The 2 outermost ropes 1A on each end of the L-bars (and on both sides of the hammock) are removed from the grooves of the L-bars 2. This allows for their attached fabric 3 to be folded (otherwise the fabric 3 would stretch too high (on the vertical) and be too deep (on the horizontal) to sit on comfortably as a regular sofa and would have a very high back).
b) The now loose edges of the fabric 3 (with their outermost connecting ropes 1A removed) fold under the remaining fabric 3 and are rethreaded through the L-bar 2 grooves.
c) The L-bars 2 are pulled/slid along the ropes 1 towards the fabric 3 and rotated 90 degrees along the z-axis (their holes sliding along the ropes), into the vertical (sofa) position.
d) As the L-bars 2 are sliding into their new vertical position, they snag knots 5 on the now top rope (or top ropes—knots can be strategically placed along them). This shortens the top rope(s) and forces the HBC to swing up from a bed orientation plane into a sofa orientation plane (with back positioned more vertically behind the sitter).

Figure 7D:
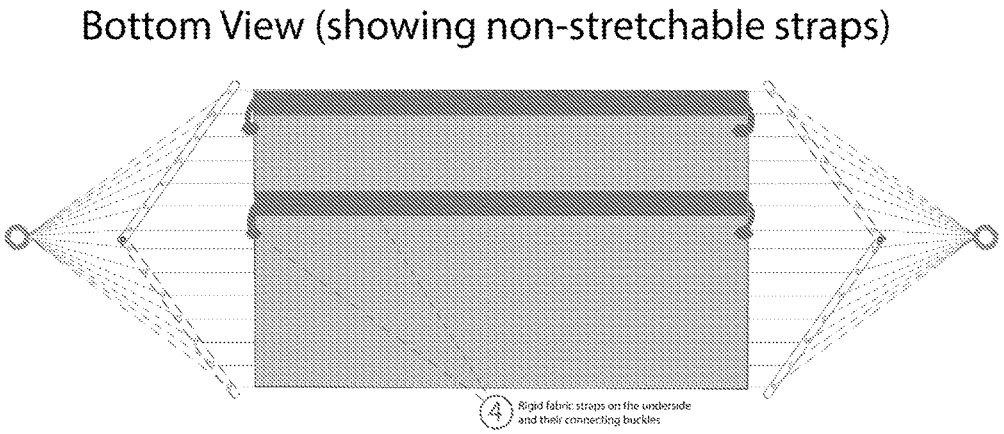
FIG. 7D is an illustration of the bottom of the hammock bed, showing non-flexible straps and buckles at their ends.

FIG. 7D is an illustration of the bottom side of the HBC showing the underside straps and their buckles 4. They are tied (to either the ropes 1 or the L-bars 2), causing the bottom fabric to tense up, so they don't sag under the sitters. There is a possibility in other embodiments that this part can be replicated on the other half of the HBC to tense up the sofa's "back" as well.

Figure 7E:
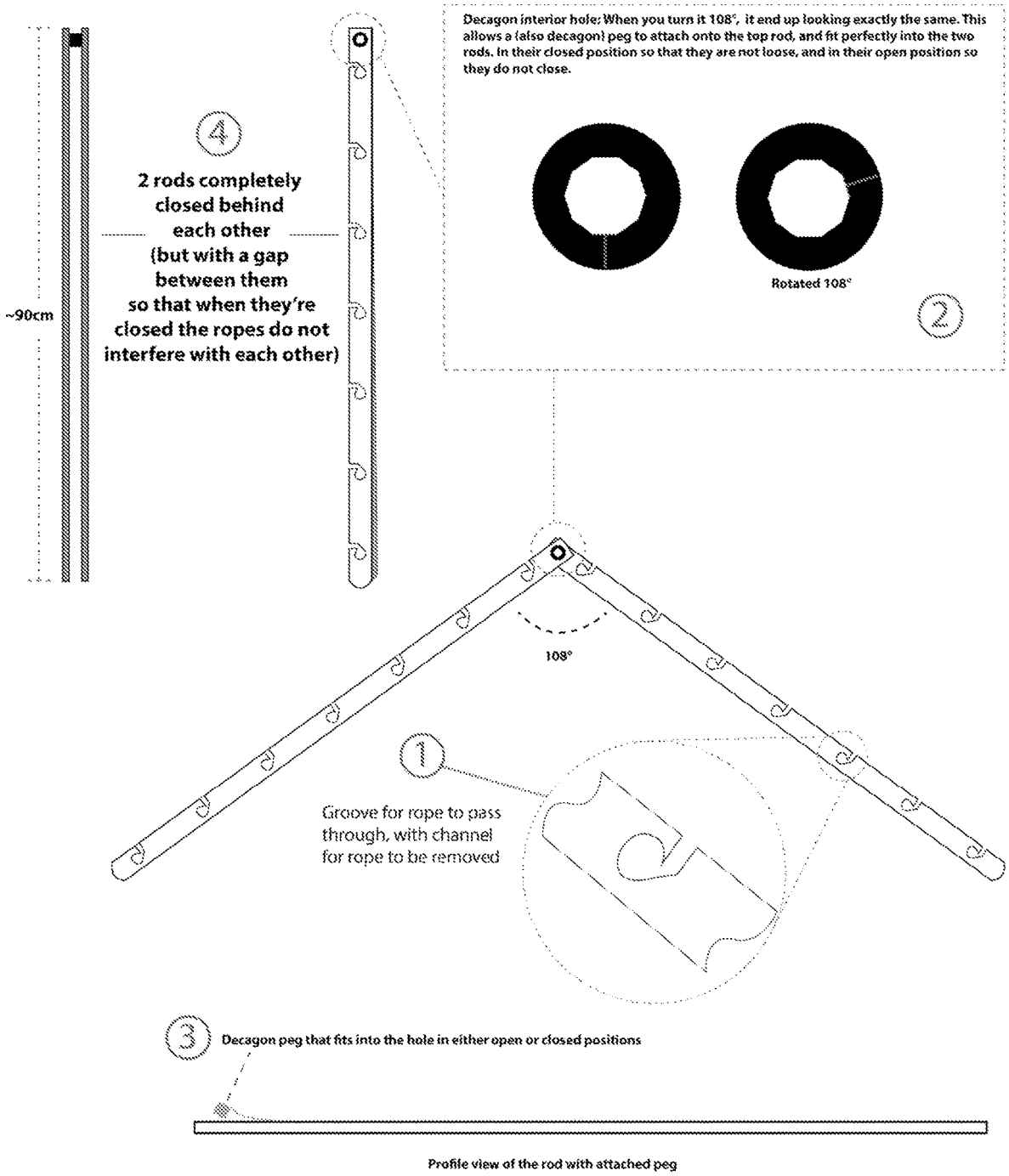
FIG. 7E is an illustration of the L-bars themselves, showing a possible simple pivot mechanism using a decagon-shaped hole, around which the L-bars fold.
Figure 8A:
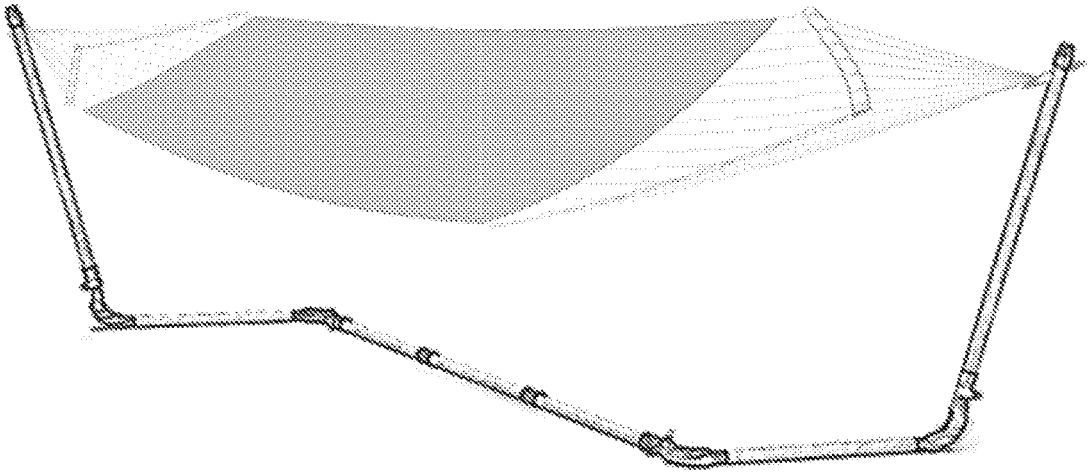
FIG. 8A is an illustration showcasing a configuration of the HSS, with the HBC in flat Bed configuration.
Figure 8B:
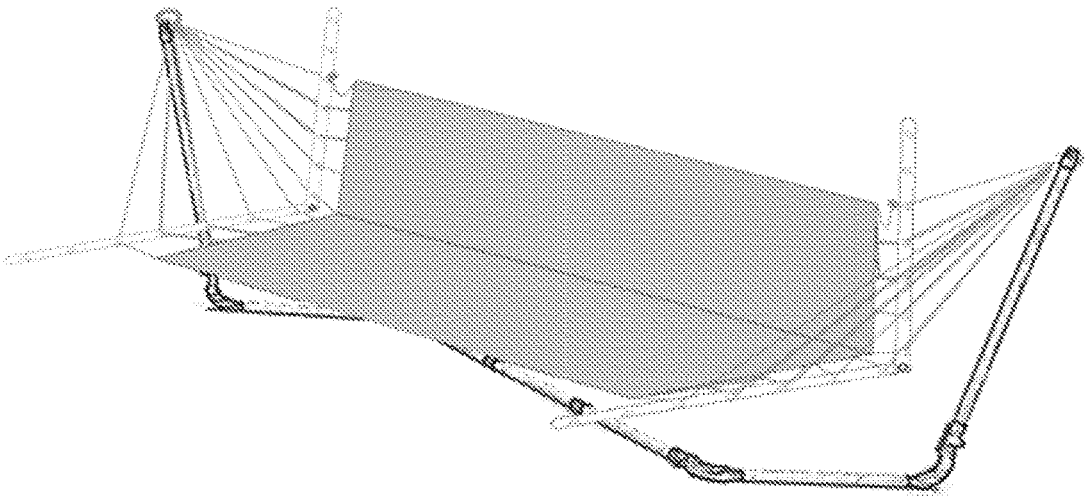
FIG. 8B is an illustration showcasing a configuration of the HSS, with the HBC in Sofa configuration.
Figure 8C:
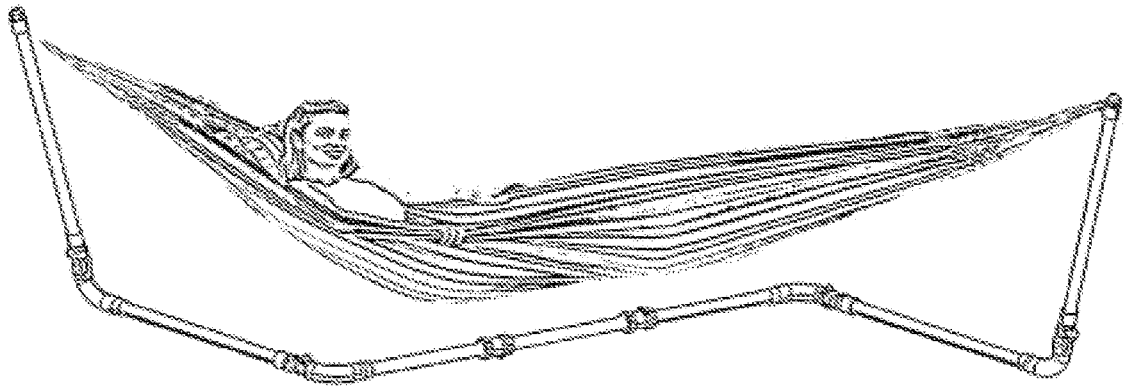
FIG. 8C is an illustration showcasing a configuration of the HSS, with the HBC stripped of its L-Bars (basically becoming a regular $3^{rd}$ party hammock bed).

FIG. 7E is an illustration of the two foldable L-bars that allow the ropes for the hammock bed to go through them (or slip out of them through channels if they are not desired i.e., in the cocoon position of the HBC—see FIG. 8C). The L-type configuration, with holes and channels in them 1, allows the bars to slide along the ropes, making two configurations possible: the flat bed configuration and the sofa configuration. Also, the L-Bars' two constituent arms can fold in onto each other 4 to minimize space when not needed (e.g., during transport or storage).

FIG. 7E further shows a possible mechanism of the pivot connecting the two arms of each L-Bar. The overlapping decagon shapes (there are two overlapping decagon rings, one for each arm) on the interior of the hole 2 is the pivot: When you turn one 108° (which is a good angle between the seat of the sofa and its back), it ends up in exactly the same as the starting position. This allows a (also decagon) peg 3 to be plugged into a hole in the top arm and fit perfectly locking the arms. In the closed position of the arms, this peg makes sure they do not pivot open. In their open position, they are locked into position and do not fold. In a preferred embodiment, the length of each arm is approximately 90 cm and is made of aluminum or titanium. However, different dimensions and materials are also possible.

FIG. 8A is an illustration showcasing a configuration of the HSS, with the HBC in flat Bed configuration.

FIG. 8B is an illustration showcasing a configuration of the HSS, with the HBC in Sofa configuration.

FIG. 8C is an illustration showcasing a configuration of the HSS in the fully unfolded position, with the HBC's L-Bars removed, effectively turning the HBC into a regular hammock bed.

Figure 8D:
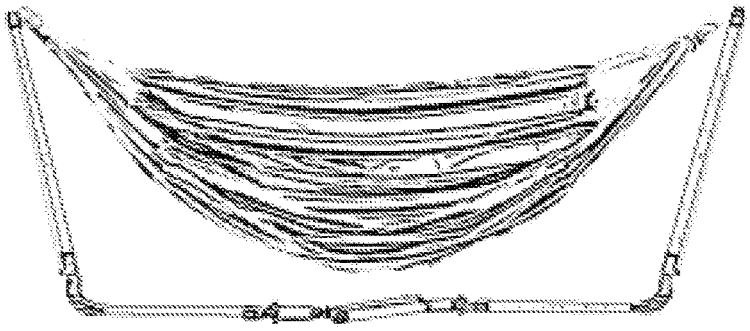
FIG. 8D is an illustration showcasing a configuration of the HSS, with a narrower hammock bed (or HBC folded widthwise in further embodiment).

FIG. 8D is an illustration showcasing a configuration of the HSS in the semi-folded position, with a chair-style hammock bed suspended on it. The HBC, in another embodiment, could also have a way to fold it in such a way as to shorten its width and allow it to be used in this HSS configuration.

According to this disclosure, the HSS offers a unique shape, which in turn addresses the issues people have had creating a portable hammock. In the current embodiment, the hammock poles of the frame are constructed out of bamboo. This further makes it unique and more environmentally friendly.

According to this disclosure, the HSS design consists of the following unique differences over traditional hammock designs, including the following:

1. Traditional hammock designs are similar to bed frames which require pillars or structures to attach to. In the absence of pillars or structures, traditional hammock design cannot be used. The HSS of this embodiment is a portable design that enables the user to carry the frame which obviates the need for pillars or structures and allows the user to set up a hammock virtually anywhere that is reasonably flat.
2. Traditional portable hammock design has limits in terms of capacity, size of person it can handle, and comfort. Traditional portable hammock designs may not support two or more people on it. Additionally, there may be a capacity cap out of up to 300 lbs. According to this embodiment, this HSS unfolds into a much larger structure (footprint), thereby allowing for a bigger and more comfortable hammock bed. Furthermore, it also has a capacity of double the weight and may support up to 550 lbs.

3. Traditional hammock designs are cumbersome to set up. It may take a few minutes to set up and take apart. According to this embodiment, this HSS can be set up and put away in a few seconds.

The HBC consists of the unique ability to transform into a legitimate sofa-type configuration and back again into a bed.

According to embodiments of this disclosure, a portable and foldable hammock apparatus is disclosed. The hammock apparatus comprises a hammock bed made of a fabric material and having two rope ends, an adjustable spreader bar at each end of the hammock bed connected to the rope ends and a hammock frame.

According to embodiments of this disclosure, the hammock frame further comprises two folding vertical bars, each folding vertical bar having a top cap and a bottom cap, three or more folding horizontal bars; and a plurality of angle hinges connecting a vertical bar to a horizontal bar or connecting two horizontal bars and a connecting mechanism connecting the fabric bed to the vertical bars at the top caps of the vertical bars. The connecting mechanism consists of a metal carabiner or metal clip.

According to embodiments of this disclosure, the angle hinges of the hammock apparatus connect the vertical bar and horizontal bar at each end, at an obtuse angle. Furthermore, the hammock apparatus the hammock frame is configured in a Z-configuration to support the hammock bed in an assembled position and can be folded for portable transport and storage in an unassembled position.

According to embodiments of this disclosure, the adjustable spreader bars of the hammock apparatus is configured to place the hammock bed into a bed or sofa configuration. The hammock apparatus further comprises a plurality of straight hinges connecting two horizontal bars.

According to embodiments of this disclosure, the vertical bars and horizontal bars of the hammock apparatus can be made of material of bamboo, Moso cane, plastic, aluminum, steel and carbon fiber. Furthermore, the hammock bed fabric can be made of cotton, polyester, wool, silk, or other suitable fabric materials.

According to embodiments of this disclosure, the dimensions of the hammock frame is approximately 300 cm in length, approximately 180 cm in width, and approximately 100 cm in height, and can support up to a weight of around 250 kilograms (kg) or 550 pounds (lbs). Furthermore, the angle hinges are angled at 105 degrees, but can support any obtuse angle from 90 degrees to 150 degrees. The hammock apparatus further comprises an adjustable steel rope configured to connect the top and bottom caps of the vertical bar.

According to embodiments of this disclosure, a portable and foldable hammock frame is disclosed. The hammock frame comprises two folding vertical bars, each folding vertical bar having a top cap and a bottom cap, three or more folding horizontal bars and a plurality of angle hinges connecting a vertical bar to a horizontal bar or connecting two horizontal bars. The hammock frame is configured in a Z-configuration to support the hammock bed and the hammock frame is configured in a folded position for portable transport and storage in an unassembled position.

According to embodiments of this disclosure, the hammock frame consists of a plurality of straight hinges connecting the horizontal bars. The hammock frame has angled hinges with an optimal angle of 105 degrees but can also support a range of 90 degrees to 150 degrees. Furthermore, the vertical bars and horizontal bars are made of material selected from a list consisting of bamboo, Moso cane, plastic, aluminum, steel and carbon fiber.

According to embodiments of this disclosure, an angled hinge assembly is disclosed. The angle hinge assembly is configured to support a hammock frame. The angled hinge assembly consists of a top piece having a first end and second end, the top piece first end configured to connect to a vertical bar of the hammock frame, and the top piece second end having a male connector with a hole therethrough; a bottom piece having a first end and second end, the bottom piece second end is configured to connect a horizontal bar of the hammock frame and the bottom piece first end configured to be a U-shaped connector with a hole therethrough; and a pin mechanism configured to connect the top piece second end to the bottom piece first end wherein the pin mechanism enables the top piece and bottom piece to pivot at an obtuse angle.

According to embodiments of this disclosure, the angle hinge assembly is configured to operate in an obtuse angle of approximately 105 degrees with a further range of 90 degrees to 150 degrees. The pin mechanism of the angle hinge assembly further comprises a pin housing, a hinge spring, a lock nut, a hinge pin, a push release button, and push release button cover. The angle hinge assembly is made of carbon fiber and the pin and spring are made of stainless steel, titanium, or aluminum.

According to embodiments of this disclosure, a straight hinge assembly is disclosed. The straight hinge is configured to support a hammock frame. The straight hinge assembly further comprises a cylindrical first piece, a cylindrical second piece having a smaller diameter than the first piece, a first cylindrical ring connecting the first piece to a first horizontal bar of the hammock frame, a second cylindrical ring connecting the first piece to a second horizontal bar of the hammock frame, a hinge spring and a hinge piston wherein the hinge spring and hinge piston is placed between the cylindrical first piece and cylindrical second piece, and when the straight hinge assembly is assembled it allows for a secure connection of the first and second horizontal piece.

According to embodiments of this disclosure, the first and second piece of the straight hinge assembly further comprises interlocking screw holes having screws that fit into the screw holes. The straight hinge assembly is made of carbon fiber and the screw and spring are made of stainless steel.

As used herein, the term "plurality" denotes two or more. For example, a plurality of components indicates two or more components. The term "determining" encompasses a wide variety of actions and, therefore, "determining" can include calculating, computing, processing, deriving, investigating, looking up (e.g., looking up in a table, a database, or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on." While the foregoing written description of the system enables one of ordinary skill to make and use what is considered presently to be the best mode thereof, those of ordinary skill will understand and appreciate the existence of variations, combinations, and equivalents of the specific embodiment, method, and examples herein. The system should therefore not be limited by the above-described embodiment, method, and examples, but by all embodiments and methods within the scope and spirit of the system. Thus, the present disclosure is not intended to be limited to the implementations shown herein but is to be accorded the widest scope consistent with the principles and novel features disclosed herein.

What is claimed is:

1. A portable and foldable hammock apparatus, comprising:

a hammock bed made of a fabric material and having two rope ends;

an adjustable spreader bar at each end of the hammock bed connected to the rope ends;

a hammock frame further comprising:

two folding vertical bars, each folding vertical bar having a top cap and a bottom cap;

three or more folding horizontal bars; and a plurality of angle hinges connecting a vertical bar to a horizontal bar or connecting two horizontal bars;

a connecting mechanism connecting the fabric bed to the vertical bars at the top caps of the vertical bars;

wherein the angle hinges connect the vertical bar and horizontal bar at each end, at an obtuse angle;

wherein in an assembled position, the horizontal bars of the hammock frame are configured in a Z-configuration on a ground surface to support the hammock bed;

wherein in an unassembled position, the hammock frame is folded for portable transport and storage.

2. The hammock apparatus of claim 1 wherein the adjustable spreader bars are configured to place the hammock bed into a bed or sofa configuration.

3. The hammock apparatus of claim 1 further comprising a plurality of straight hinges connecting two horizontal bars.

4. The hammock apparatus of claim 1 wherein the vertical bars and horizontal bars are made of material selected from a list consisting of bamboo, Moso cane, plastic, aluminum, steel and carbon fiber.

5. The hammock apparatus of claim 1 wherein the hammock bed fabric is selected from a list consisting of cotton, polyester, wool and silk.

6. The hammock apparatus of claim 1 wherein dimensions of the hammock frame are approximately 300 cm in length, approximately 180 cm in width, and approximately 100 cm in height.

7. The hammock apparatus of claim 1 is configured to support up to a weight of around 250 kilograms or 550 pounds.

8. The hammock apparatus of claim 1 wherein the angle hinges are angled at 105 degrees.

9. The hammock apparatus of claim 1 wherein the connecting mechanism is a metal carabiner or metal clip.

10. The hammock apparatus of claim 1 wherein the adjustable steel rope is configured to connect the top and bottom caps of the vertical bar.

11. A portable and foldable hammock frame, comprising:

two folding vertical bars, each folding vertical bar having a top cap and a bottom cap;

three or more folding horizontal bars; and a plurality of angle hinges connecting a vertical bar to a horizontal bar or connecting two horizontal bars;

wherein in an assembled position, the horizontal bars of the hammock frame are configured in a Z-configuration on a ground surface to support the hammock bed;

wherein in an unassembled position, the hammock frame is configured in a folded position for portable transport and storage.

12. The hammock frame of claim 11 further comprising a plurality of straight hinges connecting the horizontal bars.

13. The hammock frame of claim 11 wherein the angle hinge is configured from a range of 90 degrees to 150 degrees.

14. The hammock apparatus of claim 11 wherein the vertical bars and horizontal bars are made of material selected from a list consisting of bamboo, Moso cane, plastic, aluminum, steel and carbon fiber.

* * * * *